United States Patent [19]

Conti

[11] Patent Number: 4,973,052

[45] Date of Patent: Nov. 27, 1990

[54] INTERACTIVE MOTION SENSING TOY

[76] Inventor: Donald J. Conti, 1348 W. Hampton Pl., Palatine, Ill. 60067

[21] Appl. No.: 296,626

[22] Filed: Jan. 13, 1989

[51] Int. Cl.[5] ..... A63F 9/14

[52] U.S. Cl. ..... 273/1 GC; 273/1 GE; 273/86 B

[58] Field of Search ..... 273/1 GC, 1 GE, 1 E, 273/237, 85 G, 86 R, 86 B; 272/129, DIG. 5; 434/247, 248, 249, 255, 258, 251

[56] References Cited

U.S. PATENT DOCUMENTS

| | | | |
|---|---|---|---|
| 4,296,926 | 10/1981 | Buck et al. | 273/1 GC |
| 4,645,958 | 2/1987 | Williams | 434/251 |
| 4,728,100 | 3/1988 | Smith | 272/DIG. 5 |
| 4,735,410 | 4/1988 | Nobuta | 272/129 |
| 4,751,642 | 6/1988 | Silva et al. | 273/85 G |
| 4,824,107 | 4/1989 | French | 273/1 GC |

*Primary Examiner*—Edward M. Coven

*Assistant Examiner*—Dean Small

*Attorney, Agent, or Firm*—Welsh & Katz, Ltd.

[57] ABSTRACT

An electronic educational toy which includes a housing to contain the sensor assembly and control unit plus a plurality of output devices including visual indicators arranged to be seen by the players and an audio output device detectible by the players. In response to the manual actuation of a switch the toy produces a first signal indicative of its readiness to respond to the motion of the players. A second signal is automatically produced upon the failure of a player to abstain from moving in response to the condition of the indicators. A third signal is produced upon the manual actuation of a switch by the player after successfully responding to successive signals from the indicators. In a preferred embodiment the toy includes electronic sensing and indicating circuitry contained in a main body and base assembly that are physically configured to enhance the teaching ability of the toy.

16 Claims, 3 Drawing Sheets

INTERACTIVE MOTION SENSING TOY

FIELD OF THE INVENTION

The invention pertains to the field of toys including toys that produce an output in response to the detection of predetermined conditions established as a result of player(s) action. More particularly the invention pertains to such interactive electronic educational toys incorporating motion sensing and switching means.

BACKGROUND OF THE INVENTION

A traditional interactive children's game played by multiple players is typically called RED LIGHT/-GREEN LIGHT.

A limitation of this traditional game is that it must be played by more than one participant. The participants include a caller and the body of players.

The caller determines a RED or a GREEN LIGHT condition during which the players are respectively forbidden or permitted to move. The object of the game is to be the first player to progress across a playing field to reach and tag the caller as a consequence of alternately advancing during the GREEN LIGHT conditions and remaining motionless during the RED LIGHT conditions.

The participants begin by positioning themselves on a playing field sized appropriately for the number of players. Initially the players are located behind an arbitrary starting line which is physically separated from the position of the caller. Throughout the game the caller remains in this initial position. The caller then turns his or her back to the players and calls a GREEN LIGHT condition. After this signal and during this time the players are permitted to advance and may progress toward the caller at their own individual rates.

After an arbitrary period of time the caller abruptly turns to face the main body of players and simultaneously calls a RED LIGHT condition. At this signal, the players must immediately stop all motion and remain motionless as long as the caller is facing the players.

If the caller observed any player in motion upon turning to face the players or at any time during the RED LIGHT condition, that player is identified and sent back to the starting line to begin again upon the initiation of the next GREEN LIGHT condition. The traditional game is further limited by the lack of impartiality in the callers judgmental ability to detect motion upon turning to face the players.

If the caller did not observe player motion, the condition of GREEN LIGHT is reinstated at the callers discretion and the action is repeated for multiple cycles of RED LIGHT/GREEN LIGHT conditions until a player progresses close enough to reach and tag the caller thereby winning the game.

It would be desirable to emulate the traditional game and to overcome its limitations by providing an interactive amusement toy/game which can be played by one or more players and afford impartially in determining the relative motion of the players during a RED LIGHT condition. It would also be desirable to provide a limited teaching aid to children to instill the concepts of associating red with stop or caution and green with go or all clear.

SUMMARY OF THE INVENTION

In accordance with the present invention, an electronic toy is provided. The toy includes multiple indicators, sensors, timers, and switches to interact with one or more player(s). One such indicator includes a plurality of color coded lights usually one red and one green indicating stop and go respectively. Another indicator includes an audio output device indicating general player participation in addition to detecting motion with a sensor. A programmed microcomputer is coupled to the indicators, a motion sensor and a speaker. A randomly varying time interval is provided under program control.

The toy functions to sense the motion of the player(s) and initiate an output during the time when the stop or red indicator is lit. Motion detected during this time results in a specific audio output. When the green or go indicator is lit the audio output is altered.

The present invention also provides a teaching aid usable to associate the concept of STOP and GO with red and green lights respectively. This is accomplished as the players successfully negotiate repeated cycles of RED and GREEN LIGHT conditions to reach the location of the toy approaching it only when the green light is on and remaining motionless when the red light is on. Successful application of this sequence keeps the logic from recognizing motion and acknowledging by the subsequent generation of an audio output.

The present invention is intended to elicit player response and minimize the direct manipulation of hardware usually associated with an interactive game/toy. This concept permits a focus on the teaching ability of the toy rather than on the instrumentation or direct operation of the toy.

Additionally the present invention provides a high degree of impartiality in determining relative motion of the player(s) while allowing randomness in the timing of the STOP and GO states of the toy. Motion sensing output is activated only during the RED LIGHT condition while the sensor responds to any movement within its field of view. Each of the time durations of the RED and GREEN LIGHT conditions and hence the activation time of the sensor logic is controlled by a timer which provides switching at a random rate thereby precluding anticipation by the player(s).

DESCRIPTION OF THE PREFERRED EMBODIMENT

Figure 1:
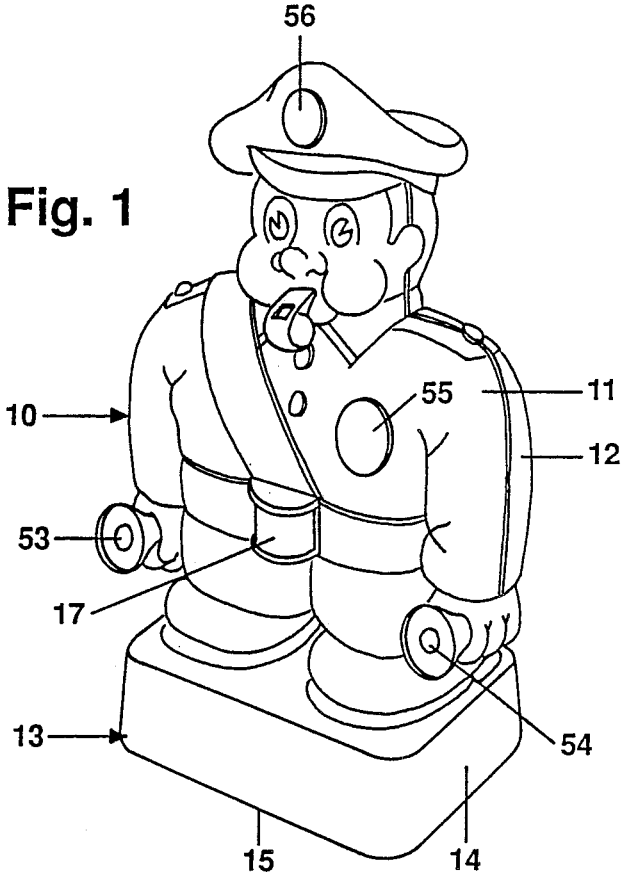
FIG. 1 is a front perspective view of a toy in accordance with the present invention.

While this invention is susceptible of embodiment in many forms, there is shown in the drawing and will be described herein in detail a specific embodiment and modifications thereof, with the understanding that the present disclosure is to be considered as exemplification of the principles of the invention and various changes in the details may be made without departing from the spirit, or sacrificing any of the advantages of the present invention.

A toy incorporating the present invention is physically configured in an image designed to enhance the teaching ability of the toy.

Figure 2:
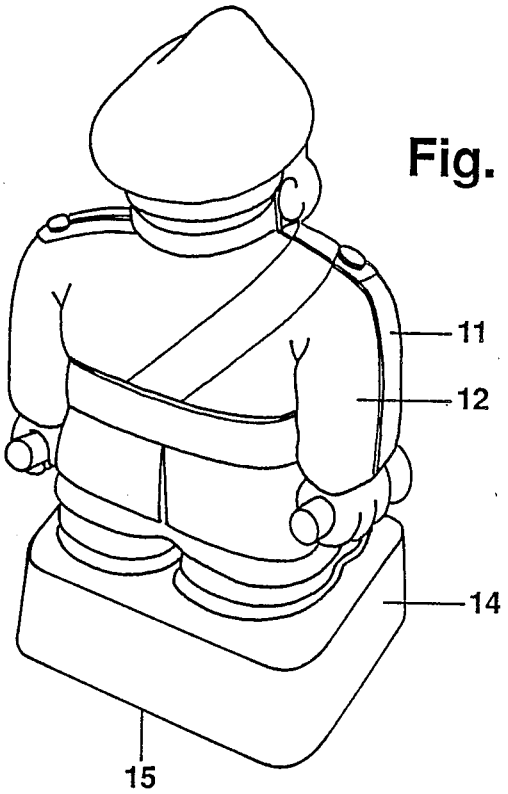
FIG. 2 is a rear perspective view of the toy depicted in FIG. 1.

Referring to FIG. 1 and FIG. 2 there is shown a toy according to the preferred embodiment of the present invention which has a housing 10 consisting of a front member 11, a back member 12 and a base assembly 13. The base assembly 13 has a top member 14 and bottom cover 15. A motion sensing means 17 is mounted in the housing 10. A transducer 60 is used to sense motion.

The front member 11 of the housing 10 supports the red indicator 53, green indicator 54 and a switch 55 to start the game. A switch 56 is also provided to end the game. The base assembly 13 houses an electronic printed circuit board which carries the logic circuitry 52 shown in FIG. 4 and the batteries to power the game. The front member 11 of the housing 10 also supports a smaller electronic printed circuit board located behind motion sensing means 17. This circuit board contains the sensing circuitry 51 as shown in FIG. 4.

Figure 3:
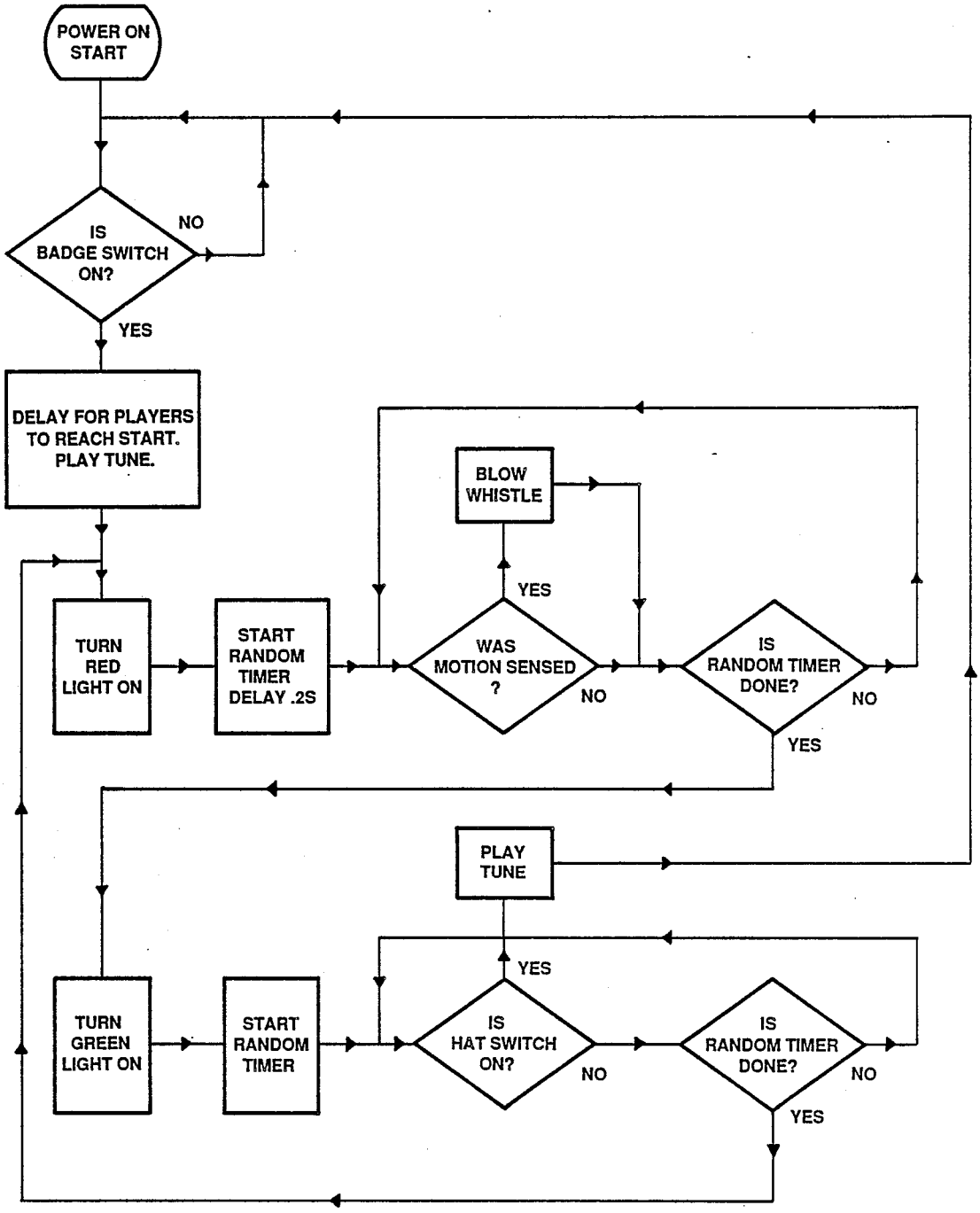
FIG. 3 is the flow diagram of the various steps associated with the using and the sequence of operation of the toy depicted in FIG. 1.

FIG. 3 is the logic diagram illustrating the various steps associated with the sequence of operation of such a toy. Upon independent power initiation of the game the badge switch 55 is momentarily depressed thereby triggering a time delay controlled by the circuitry which disables the motion sensing means and the indicator lamps 53 and 54 for a predetermined length of time. After this time delay the indicator lamps, typically one red and one green, light alternately, each for a random period of time so as not to be anticipated by the player(s). During the time period when the red lamp 53 is lit the motion sensing circuitry is enabled and should motion be detected a first audio output tone is generated to indicate such detection. If no motion is detected the tone is inhibited. A signal from the motion sensing means 17 is processed in accordance with the sequence of operation shown in FIG. 3. This sequence continues until the switch 56 is depressed during the time when the green lamp is lit thus producing a second audio output tone different from the first and indicative of success. The logic and control signals are generated by the circuitry in FIG. 4.

Figure 4:
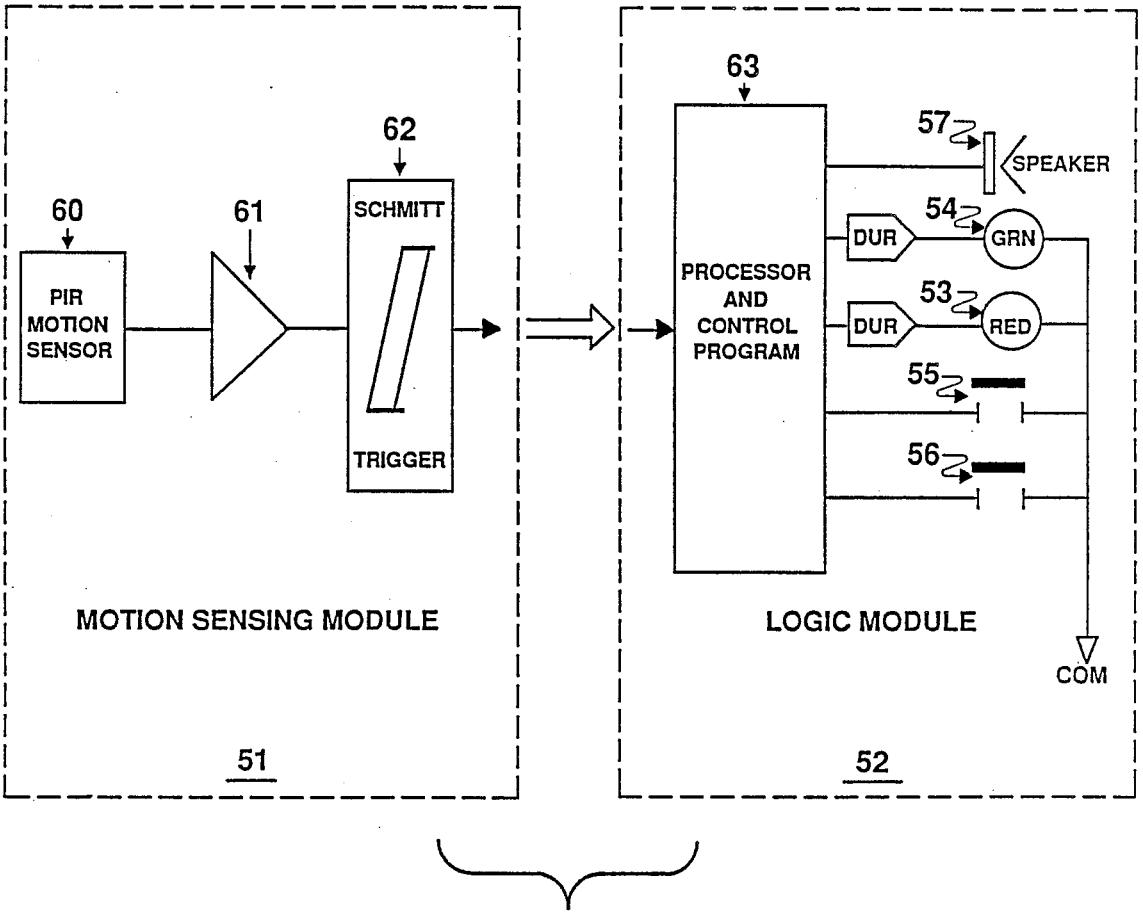
FIG. 4 is an electrical schematic block diagram of the motion sensor, logic module and output devices of the toy depicted in FIG. 1.

FIG. 4 shows the interconnection of the motion sensing circuitry 51 which uses passive infrared technology and the logic module 52 with its associated microcomputer and I/O devices. Alternative motion sensing technologies such as ultrasonic and photoelectric may also be used. The passive infrared sensor 60 is sensitive to thermal energy in the frequency range associated with the human body. The intrinsic characteristics of the device further narrow this sensitivity to changes in thermal energy as produced when motion is present in the field of view. The small signal developed by the sensor 60 when motion is sensed, is increased and shaped by amplifier 61 and coupled to a schmitt trigger window detector 62 which only allows an input signal of a predetermined magnitude to cause it to produce an output. This acts as a filter to further restrict the detection of motion to a practical level. The output of comparitor 62 is coupled to the logic module 52 and more specifically to a microcomputer 63 that includes a stored program which, in combination with the described hardware implements the steps of the flow diagram in FIG. 3.

The microcomputer 63 also includes the audio patterns which drive the speaker 57 thus providing the feedback audio output to the game players. Such audio feedback includes a plurality of tones and digitized speech synchronized to specific events as referenced in FIG. 3.

These predetermined audio patterns are used separately and in conjunction as appropriate for an event. For instance, upon detection of motion during the time the red lamp is lit, an appropriate audio speech message is produced, typically 'STOP! . . . GO BACK'. Alternatively appropriate, is the production of a whistle tone in conjunction with the audio message 'STOP!'. Similarly, the condition when the green lamp is lit, is preceded by the audio instruction 'GO'. Upon actuation of switch 56 during the time the green lamp is lit, the tones of an appropriate victory tune are produced and indicate successful game completion. Alternatively appropriate, is the production of a victory tune in conjunction with an audio message, typically 'YOU WIN'.

As is apparent from FIG. 1 the housing 10 is depicted in the form of a friendly policeman holding a red flashlight and a green flashlight. This arrangement is especially appropriate for young children to acclimate themselves to following instructions associated with traffic safety. Therefore the likeness of the toy serves to reinforce the teaching ability of the toy.

Thus there has been disclosed an electronic toy used by one or more players to play a game which is both interactive and educational. From the forgoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims, all such modifications as fall within the scope of the claims.

What is claimed is:

1. A toy, usable by one or more players in a game having at least one performance condition, comprising:

(a) a housing;

(b) first means disposed in said housing for indicating a first game performance condition;

(c) second means disposed in said housing for indicating a second game performance condition, said second condition being different from said first condition;

(d) electronic control means disposed in said housing and connected to said first and second indicating means, said control means being configured to automatically alternate between the energization of said first indicating means and said second indicating means;

(e) a random variable duration electronic timing means connected to said control means for randomly varying the duration of said energization of said first and second indicating means;

(f) detecting means connected to said control means for detecting player performance only during the energization of said second indicating means; and (g) player performance indicating means coupled to said detecting means for indicating player performance during the energization of said second indicating means.

2. The toy as defined in claim 1 wherein said first and second indicating means each include visible, electrically energized indicators.

3. The toy as defined in claim 2 wherein said detecting means includes means for sensing motion of one or more of the players.

4. The toy as defined in claim 3 wherein said motion sensing means includes passive infrared detecting means for detecting movement of the players.

5. The toy as defined in claim 1 wherein said timing means includes an electronic microcomputer.

6. The toy as defined in claim 1 wherein said control means includes a microcomputer.

7. The toy as defined in claim 1 further including means connected to said control means for generating audio feedback to the one or more players in response to player performance.

8. The toy as defined in claim 7 wherein said control means includes a computer.

9. A toy usable by a group of players comprising:

(a) a housing;

(b) variable time duration control means carried by said housing for automatically controlling the distribution and duration of an electrical signal;

(c) a first indicator disposed in said housing and coupled to said control means for energization by said signal so as to indicate a first selected performance condition;

(d) a second indicator coupled to said control means for energization by said signal so as to indicate a second selected performance condition, said control means randomly alternating the duration of energization of said first indicator and said second indicator;

(e) a random variable duration electronic timing means connected to said control means for randomly varying the duration of said energization of said first and second indicating means; and (f) detecting means for detecting a failure by a player in the group of players to conform only to said second condition.

10. The toy as defined in claim 9 wherein said control means includes an electronic timer.

11. The toy as defined in claim 9 wherein said detecting means includes means for sensing motion by one or more players of the group.

12. The toy as defined in claim 11 wherein said motion sensing means includes a passive infrared detector.

13. The toy as defined in claim 9 further including manually operable means for generating a selected electrical signal indicative of one of the players being positioned adjacent thereto.

14. The toy as defined in claim 9 further including means connected to said control means for generating audible feedback signals detectable by the group of players.

15. The toy as defined in claim 14 wherein said control means includes a programmed computer.

16. A toy usable by one or more players as a game having at least one performance condition, comprising:

(a) a housing;

(b) control means disposed in said housing for automatically controlling the distribution and duration of electrical signals;

(c) first indicating means coupled to said control means for indicating a first game condition when energized by said signals;

(d) second indicating means coupled to said control means for indicating a second game condition when energized by said signals, said second game condition being distinct from said first condition;

(e) first manual switching means disposed in said housing and connected to said control means for initiating the distribution of signals by said control means to said first indicating means;

(f) said control means including random variable duration timing means to automatically alternate the energization of said first and second indicating means so that each such indicating means is energized for a randomly varying duration;

(g) motion detecting means connected to said control means for detecting motion of the players only during energization of said second indicating means;

(h) second manual switching means disposed on said housing and connected to said control means to prevent the energization of said second indicating means; and (i) said second manual switching means also being connected to victory indicating means for energization thereof upon activation of said second manual switching means.

* * * * *